United States Patent [19]

Brasington

[11] Patent Number: 4,845,790

[45] Date of Patent: Jul. 11, 1989

[54] METHOD AND APPARATUS FOR ALTERING FABRIC FINISHES

[75] Inventor: Mitchell R. Brasington, El Paso, Tex.

[73] Assignee: East-West Apparel, Inc., El Paso, Tex.

[21] Appl. No.: 226,193

[22] Filed: Jul. 29, 1988

Related U.S. Application Data

[63] Continuation-in-part of Ser. No. 189,341, May 2, 1988.

[51] Int. Cl.[4] ..... D06F 31/00; D06B 21/00

[52] U.S. Cl. ..... 8/150; 8/158; 8/159; 51/313; 68/9; 68/13 R; 68/205 R

[58] Field of Search ..... 8/149.3, 150, 158, 159; 68/5 R, 9, 13 R, 205 R; 51/313

[56] References Cited

U.S. PATENT DOCUMENTS

| | | | |
|---|---|---|---|
| 4,575,887 | 3/1986 | Viramontes | 8/158 |
| 4,750,227 | 6/1988 | Hopkins et al. | 8/158 |
| 4,765,100 | 8/1988 | Majors | 51/313 |

FOREIGN PATENT DOCUMENTS

| | | | |
|---|---|---|---|
| De3129699 | 2/1983 | Fed. Rep. of Germany | 68/29 |

*Primary Examiner*—Philip R. Coe

*Attorney, Agent, or Firm*—Browning, Bushman, Zamecki & Anderson

[57] ABSTRACT

Improved methods and apparatus are provided for altering fabric finishes on a garment to give the garment a "lived-in" or worn appearance before the garment is actually worn by the user. According to the method of the present invention, a batch of garments is preferably stone-washed to generally fade and abrade the entire garment. The garment is then inflated by passing air through an inlet port in the garment and by substantially sealing one or more exit ports in the garment to create a greater than atmospheric pressure within the garment. The inflated garment is then sprayed with a low-strength bleaching solution on selected exterior portions to provide an additional fading or worn appearance on those portions of the garment. Thereafter, the garment is placed in a neutralizing liquid to chemically counteract the sprayed bleaching solution. A plurality of garments may be each suspended from a common air duct interconnected with a blower for providing air to inflate the garments. The garment is preferably rotatable with respect to the air duct so that the garment may be easily rotated by an operator to a selective position for the spraying operation.

20 Claims, 1 Drawing Sheet

METHOD AND APPARATUS FOR ALTERING FABRIC FINISHES

CROSS-REFERENCE TO RELATED CASES

The present application is a continuation-in-part of U.S. Ser. No. 189,341 filed May 2, 1988.

BACKGROUND OF THE INVENTION

1. Field of the Invention

The present invention relates to methods and apparatus for bleaching clothes and, more particularly, relates to techniques for "stone-washing" clothes and thereafter further bleaching the clothes at selected locations to create a "worn" appearance.

2. Description of the Background

Blue jean manufacturers have known for a long time that the public frequently prefers to purchase a garment that appears worn or used, rather than appearing new. Accordingly, blue jean manufacturers frequently fade new garments with a bleaching solution such as potassium permanganate. In order to obtain the desired effect, these garments are frequently "stone-washed" by the garment manufacturer or its agent, such that the garments when sold have a generally faded or "old" appearance.

Stone-washing of garments has become increasingly popular in the past decade. This process generally consists of exposing the garments, such as jeans, to a combination of a bleaching liquid and an abrasive material, so that the jeans become both faded and appear to have been worn. The abrasive action obtained by stone-washing may be generated by various techniques, including (1) tumbling the garments with an abrasive stone, metal, or plastic material in a "dry" process, (2) tumbling the garments in a washing machine wherein the internal walls of a washing machine cylinder have been previously abraded by a volcanic rock, (3) washing the garments in water containing pumice rock, as generally described in German specification No. DE 129699, or (4) agitating the garments in water and pumice sand, as disclosed in U.S. Pat. No. 4,575,887.

Although stone-washing is widely used, garments treated by this process do not have the desired look and appearance of used garments. Since stone-washed garments are not as desirable in appearance as garments which have been actually used for extended periods of time, some members of the public buy new garments or stone-washed garments and further bleach the garment to create a more used appearance. This process, however, generally tends to excessively bleach the garment or portions thereof to which the bleach is applied, so that the resulting product still does not have the desired worn or "lived-in" appearance. Moreover, the garment will have usually have wrinkles in areas where the bleach is applied, so that the garment is not uniformly treated and "streaks".

The garment may, of course, be actually worn for extended periods of time by the purchaser to obtain the desired worn or lived-in look, but obtaining this appearance takes a great deal of time. Moreover, the garment frequently tends to deteriorate or becomes soiled with a material which cannot be washed out of the garment as the garment is worn over this extended period of time, so that often the garment obtains the desired "lived-in" appearance just about the time that the garment tears or otherwise becomes ruined.

One technique used by garment manufacturers to create a desired worn appearance in garments is to stone-wash the garment, then shot blast selected areas of the garment which would normally be subjected to greater wear by the user. The treated garment thus does appear to have been previously worn by a person, since it is actually abraded in selected areas. Unfortunately, this shot blasting operation does significantly wear the material of the garment, and accordingly the tear and tensile strength of the garment material is substantially reduced in the shot blasted area. The garment when actually worn by the user thus has an increased likelihood of being torn in the area where the garment was shot blasted to create the desired effect. Moreover, shot blasting is time consuming and expensive, so that the cost of garments treated according to this process is high.

The disadvantages of the prior art are, however, overcome by the present invention, and improved methods and apparatus are hereinafter disclosed for giving garments a worn appearance by selectively spraying areas of the garment with a bleaching solution, such as potassium permanganate, while the garment is inflated with gas.

SUMMARY OF THE INVENTION

Garments are treated to provide a desired worn or "lived-in" appearance according to the present invention without causing substantial abrasion to the material of the garment. Selected areas of the garment are easily and inexpensively treated which would normally be subjected to high wear by the user, so that the desired appearance of the garment is obtained. The methods and apparatus described below are capable of treating various garments, and are particularly well suited for treating jeans or "blue jeans", as described subsequently.

Jeans may first be stone-washed in a vessel containing a bleaching solution and an abrasive material, such as pumice rock. The stone-washing operation will slightly abrade and bleach all portions of the garment, and will thus generally create a desired worn or used appearance. Stone-washed jeans are then preferably supported adjacent the belt area on a discharge end of an air duct, such that the waist of the jeans fits over the air duct. The legs of the jeans are then substantially closed off, and air is pumped into the jeans to inflate the jeans. Greater than atmospheric pressure is thus created within the interior cavity of the jeans which is normally occupied by the legs and lower torso of the user. A manually manipulated gun is used to spray a low-strength bleaching solution on selected exterior surfaces of the jeans, e.g., those areas adjacent the lower portion of the back pockets and the front thigh between the knee and below the front pockets. After a selected period of time sufficient to allow the low-strength bleaching liquid to bleach these areas and create a worn look to the jeans, the jeans are removed from the air inflation machine and are placed in a neutralizing liquid to prohibit further deterioration by the bleaching liquid.

The apparatus of the present invention comprises a power blower and an air duct which distributes air from the blower to a plurality of outlets each having a pair of jeans positioned over the respective one of the outlets. A pair of downwardly extending rods each fit within a respective leg of the jeans to retain the jeans during the spraying process in a configuration substantially similar to the configuration of the jeans when worn by the user.

A manually manipulatable spray gun is used to apply the bleaching solution to the inflated jeans, which are thereafter placed in a tank of neutralizing liquid.

It is an object of the present invention to provide an improved technique for treating a garment to obtain a natural worn appearance.

It is another object of the invention to provide a technique for treating garments to create a desired worn appearance without substantially reducing the tear and tensile strength of the garments.

Stil another object of the present invention is to provide an improved, low-cost technique for treating a garment utilizing a selected gas to inflate the garment, then spraying a bleaching solution on the inflated garment.

A feature of the present invention uses sprayed potassium permanganate to bleach the garment and create a worn appearance, with the garment thereafter being placed in a neutralizing solution to counteract the potassium permanganate.

It is an advantage of the present invention that jeans may be inexpensively and reliably treated to create a desired worn or live-in appearance by stone-washing the jeans, then blowing compressed air into an entry port of the jeans while substantially sealing off exit ports so as to inflate the jeans, and spraying the inflated jeans with a weak potassium permanganate solution, and finally neutralizing the potassium permanganate by applying a neutralizing liquid to the sprayed areas of the jeans.

These and further objects, features, and advantages of the present invention will become apparent from the following detailed description, wherein reference is made to the figures in the accompanying drawings.

DETAILED DESCRIPTION OF PREFERRED EMBODIMENTS

The techniques of the present invention allow garments to be selectively bleached in areas which create a desired "worn" look for the garment. The invention is particularly applicable to the commercial treatment of new garments in a batch process. Typically, one-thousand garments or more may be delivered by a garment manufacturer to a facility for a stone-washing and bleaching operation, and the garments batch-treated according to the present invention in selected lot sizes. Stone-washed and bleached garments are typically returned to the manufacturer for wholesale shipment to retailers. "Blue jeans" are one of the more popular garments to be treated according to the present invention, although the invention is applicable to other garments and wearing apparel, including jackets, shirts, dresses, etc.

Figure 1:
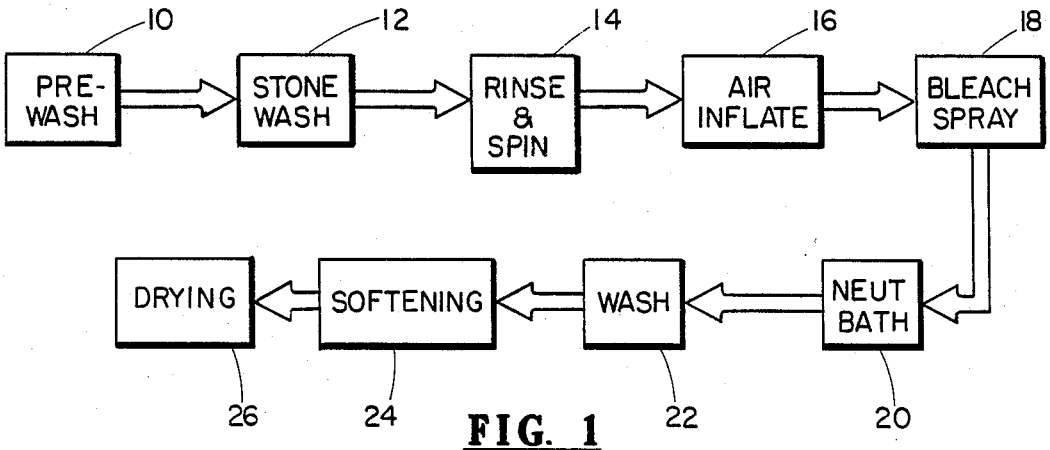
FIG. 1 is a flow block diagram of the method according to the present invention.

Referring now to FIG. 1, a technique of the present invention is generally shown in block diagram form. A batch of new blue jeans from a manufacturer are first pre-washed in step 10 to remove sizing. The washed jeans are then stone-washed by operation 12 according to conventional techniques. Although any of the processes described earlier may be used for stone-washing the jeans to create a somewhat worn or faded appearance, the batch of jeans are preferably agitated in a standard water/soda ash solution having a quantity of pumice rock to slightly abrade the jeans. Due to the stone-washing step 12, the jeans are thus generally bleached or faded, and are slightly abraded by the pumice rock. The batch of jeans are then rinsed in step 14 to remove grit, and are spun to extract most of the water and obtain the desired dampness for the subsequent bleach spraying operation.

After the rinse and spin step 14, the jeans are preferably inflated during step 16 according to the techniques described further below. For the present, however, it should be understood that step 16 causes the jeans to assume a "full" appearance, so that the jeans have few if any wrinkles, particularly in areas of the jeans which will subsequently be sprayed with bleach. Once inflated, selected areas of the jeans, typically on the front thigh area of the jeans from the knee to just below the top pocket, and on the rear of the jeans from the bottom of the back pocket to slightly below the back pocket, are sprayed with a weak potassium permanganate solution. The composition of the spray solution may vary, although preferably the solution consists of from 10 to 40 grams of potassium permanganate, and perferably from 15 to 25 grams of potassium permanganate, per gallon of water. The sprayed jeans are, however, still damp from the previous rinsing operation when the bleaching solution is sprayed on the jeans. Selected portions of the jeans are thus sprayed in step 10 with a bleaching solution ejected from a hand-held spray gun manipulated by an operator. Preferably the selected front area of the jeans are sprayed using substantially a vertical reciprocating motion.

Once the jeans have been sprayed in step 18, the jeans may be set aside for a few minutes to give the potassium permanganate time to bleach the sprayed areas of the jeans. In a few minutes, the sprayed area turns yellow, and the jeans are then placed in a vat of sodium metabisulfite so neutralize the potassium permanganate and stop the bleaching process. After the jeans are neutralized in step 22, the jeans are preferably again washed in step 22 to remove chemicals from the jeans, are softened in step 24, and are finally dried in step 26. The dried jeans may then be returned to the manufacturer in batch lots, and are subsequently delivered to stores for sale to the retail market.

Figure 2:
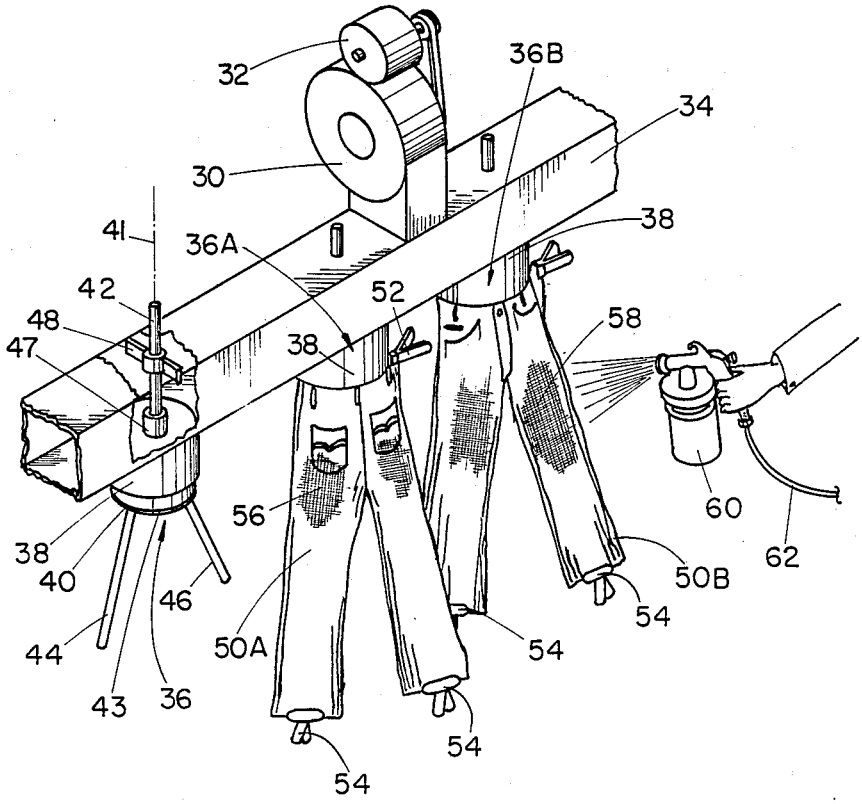
FIG. 2 is pictorial view, partially in cross-section, of suitable equipment for bleaching garments to create a worn appearance according to the present invention.

FIG. 2 depicts suitable apparatus for performing the steps 16 and 18 of the above-described process. A conventional blower 30, such as a "squirrel-cage" blower, is powered by electric motor 32 for delivering a large quantity of air to inflate a plurality of jeans. The air is discharged from the blower to a header duct 34, which supplies air to each of a plurality of jean mounting devices 36 provided at selected intervals along the axis of duct 34. A sleeve-like discharge duct 38 is weldably affixed to and extends generally downward from the header duct 34, with the axis of discharge duct 38 substantially aligned with the axis 41 of each mounting device 36.

Mounting device 36 comprises a rod 42 which extends downward through the header duct 34 and terminates slightly below the discharge duct 38. A plurality of braces 48 fixedly interconnect the rod 42 to the header duct 34, and provide the desired rigidity for the rod to mount a bearing 47 on the end of the rod 42. Bearing 47, in turn, is rigidly connected to swivel sleeve 40 by support rods, (not shown), so that sleeve 40 can freely rotate about the axis of rod 42. A pair of legs 44, 46 each extend generally downward and radially outward slightly from the axis 41 of the rod 42 to provide support for the pair of jeans.

A pair of jeans is generally attached to the swivel sleeve 40 about the waist or belt area of the jeans. Although various techniques may be used for mounting the jeans to the device 36, it is convenient to use a simple clip 52 to form a tuck in the jeans to snugly fit the jeans about the swivel sleeve. A slight ledge of lip 43 on the lower end of the swivel sleeve 40 assists in holding the jeans on the sleeve 40 with the clip 52 in place. Each rod 44, 46 fits within the corresponding leg of the jeans, as previously noted. In this manner, the operator can freely rotate the pair of jeans 50 about the axis 41 of the mounting device.

Air thus enters the jeans through the entry port provided by the waist of the jeans. In order to keep the jeans fully inflated and create a pressure within the interior of the jeans greater than atmospheric pressure, the exit ports of the jeans are preferably substantially blocked. Accordingly, each leg of the jeans is preferably restricted by a snap clip 54 at a position generally adjacent the ankle of the wearer. Snap clip 54 will not, of course, entirely block all the air from exiting the jeans, since this is not necessary. Rather, the clips 54, in conjunction with the duct 38, swivel sleeve 40, and clip 52, allow the jeans to easily become inflated so that there are few if any wrinkles in the jeans.

In FIG. 2, the rear of the jeans on the mounting device 36A have been sprayed, and the shading 56 shows the area where potassium permanganate is sprayed onto the rear of the jeans. Once sprayed, the jeans may be rotated about the mounting device, so that the sprayed area 58 on the front of the jeans is shown for the jeans on the mounting device. Potassium permanganate is easily sprayed by the operator from a conventional industrial spray gun 60, which is powered by compressed air to the gun input through line 62.

It should be understood that the apparatus as depicted in FIG. 2 is exemplary, and that various other apparatus may be provided for treating selected areas of the garment so as to create a more worn or faded appearance on those selected areas of the garment. As previously indicated, however, the bleaching solution which is applied during step 18 is preferably a low-strength bleaching solution, so that one cannot easily detect the boundary layers between an area where the bleaching solution has been applied and an area where the bleaching solution is not applied. Moreover, the bleachng solution is preferably applied by a spraying process, so that the operator can easily control the appearance of the faded area by altering the time that the solution is applied to a particular area.

As noted above, the concept of the present invention relies upon inflating the jeans with a selected gas to achieve a "full" effect and minimize wrinkles in the jeans which would adversely affect the desired uniform "worn" appearance in the sprayed areas. Air is a convenient gas for inflating the jeans in accordance with step 16, although it should be understood that other gases may also be utilized to inflate the jeans.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A method of altering fabric finishes on a garment to create a worn appearance on the garment prior to the garment being worn by the user, the method comprising:
   (a) stone-washing the garment in a vessel containing a bleaching solution;
   (b) blowing air into an inlet port in the stone-washed garment to create a greater than atmospheric pressure within an interior chamber of the garment normally occupied by the user, so as to inflate the garment;
   (c) spraying a low-strength bleaching solution on selected exterior portions of the garment while the garment is being inflated with air; and
   (d) thereafter placing the sprayed garment in a neutralizing liquid to chemically counteract the sprayed bleaching solution.

2. The method as defined in claim 1, further comprising:
   substantially sealing one or more exit ports in the garment through which inflation air is discharged to increase the pressure in the inflated garment.

3. The method as defined in claim 2, wherein
   the garment is positioned during step (b) such that the inlet port is positioned vertically above each of the one or more exit ports; and
   the garment is suspended during s teps (b) and (c) at location substantially adjacent the inlet port.

4. The method as defined in claim 2, wherein the inlet port is the waist of a pair of jeans, and the one or more exit ports are each a leg end of the pair of jeans.

5. The method as defined in claim 1, wherein step (a) comprises:
   agitating the garment in a liquid bath containing the bleaching solution and an abrasive material.

6. The method as defined in claim 1, wherein the low-strength bleaching solution is a potassium permanganate solution having a concentration of from 10 to 40 grams of potassium permanganate per gallon of water.

7. The method as defined in claim 6, wherein the neutralizing solution is sodium metabisulfate.

8. The method as defined in claim 1, further comprising:
   suspending the garment from a swivel such that the garment can be rotated during step (c).

9. The method as defined in claim 8, wherein air is discharged through the swivel and into the inlet port of the garment.

10. A method of altering fabric finishes on a garment to create a worn appearance on the garment prior to the garment being worn by the user, the method comprising:
   (a) washing the garment to generally fade the garment;
   (b) blowing gas into an inlet port in the washed garment to create a greater than atmospheric pressure within an interior chamber of the garment normally occupied by the user, so as to inflate the garment;
   (c) spraying a bleaching solution on selected exterior portions of the garment while being inflated with gas; and
   (d) thereafter applying a neutralizing liquid to the exterior portions of the garment to chemically counteract the sprayed bleaching solution.

11. The method as defined in claim 10, further comprising:

substantially sealing one or more exit ports in the garment through which inflation gas is discharged to increase the pressure in the inflated garment.

12. The method as defined in claim 11, wherein the garment is positioned during step (b) such that the inlet port is positioned vertically above each of the one or more exit ports; and the garment is suspended during steps (b) and (c) at a location substantially adjacent the inlet port.

13. The method as defined in claim 10, wherein step (a) comprises:

agitating the garment in a liquid bath containing a bleaching solution and an abrasive material.

14. The method as defined in claim 10, wherein the sprayed bleaching solution is a potassium permanganate solution having a concentration of from 10 to 40 grams of potassium permanganate per gallon of water.

15. The method as defined in claim 10, further comprising:

suspending the garment from a swivel such that the garment can be rotated during step (c); and gas is discharged through the swivel and into the inlet port of the garment during step (b).

16. Apparatus for altering fabric finishes on a garment to create a worn appearance on the garment prior to the garment being worn by the user, the apparatus comprising:

washing means for washing the garment in a vessel containing a bleaching solution to generally fade the garment:

blower means for blowing air into an inlet port in the washed garment to create a greater than atmospheric pressure within an interior chamber of the garment normally occupied by the user, so as to inflate the garment:

sprayer means for spraying a low-strength bleaching solution on selected exterior portions of the garment while being inflated with air; and applicator means for applying a neutralizing liquid to the selected exterior portions of the garment to chemically counteract the sprayed bleaching solution.

17. The apparatus as defined in claim 16, further comprising:

sealing means for substantially sealing one or more exit ports in the garment through which inflation air is discharged to increase the pressure in the inflated garment.

18. The apparatus as defined in claim 17, wherein the low-strength bleaching solution is a potassium permanganate solution having a concentration of from 10 to 40 grams of potassium permanganate per gallon of water.

19. The apparatus as defined in claim 16, further comprising:

swivel means for suspending the garment at a location adjacent the inlet port such that the garment may be rotated as the low-strength bleaching solution is sprayed on the selected exterior portions.

20. The apparatus as defined in claim 19, wherein the swivel means has a through passageway for transmitting air from the blower means to the inlet port of the garment.

* * * * *